United States Patent [19]

Tojo et al.

[11] Patent Number: 4,801,248

[45] Date of Patent: Jan. 31, 1989

[54] VARIABLE CAPACITY SWASH PLATE COMPRESSOR

[75] Inventors: Kenji Tojo; Yuzo Kadomukai; Kunihiko Takao; Yozo Nakamura, all of Ibaraki; Atsushi Suginuma, Mito; Isao Hayase; Yukio Takahashi, both of Katsuta, all of Japan

[73] Assignee: Hitachi, Ltd., Tokyo, Japan

[21] Appl. No.: 83,290

[22] Filed: Aug. 10, 1987

[30] Foreign Application Priority Data

Sep. 5, 1986 [JP] Japan ..... 61-207900

[51] Int. Cl.[4] ..... F04B 1/26; F04B 27/08

[52] U.S. Cl. ..... 417/222; 417/269; 92/12.2; 74/60

[58] Field of Search ..... 417/222, 269, 270; 92/12.2; 74/60

[56] References Cited

U.S. PATENT DOCUMENTS

| | | | |
|---|---|---|---|
| 2,964,234 | 12/1960 | Loomis, III | 74/60 X |
| 3,062,020 | 11/1962 | Heidorn | 417/222 X |
| 3,319,874 | 5/1967 | Welsh et al. | 92/12.2 X |
| 3,861,829 | 1/1975 | Roberts et al. | 417/270 X |
| 3,959,983 | 6/1976 | Roberts et al. | 62/226 |
| 4,105,370 | 8/1978 | Brucken et al. | 417/222 |
| 4,178,135 | 12/1979 | Roberts | 417/222 |
| 4,178,136 | 12/1979 | Reid et al. | 417/269 |
| 4,428,718 | 1/1984 | Skinner | 417/222 |
| 4,506,648 | 3/1985 | Roberts | 417/222 X |
| 4,586,874 | 5/1986 | Hiraga et al. | 417/222 |
| 4,664,604 | 5/1987 | Terauchi | 417/222 |
| 4,674,957 | 6/1987 | Ohta et al. | 417/222 |
| 4,685,866 | 8/1987 | Takenaka et al. | 417/222 |
| 4,687,419 | 8/1987 | Suzuki et al. | 417/222 |

FOREIGN PATENT DOCUMENTS

| | | | |
|---|---|---|---|
| 150987 | 8/1984 | Japan | 417/222 |

*Primary Examiner*—Paul F. Neils

*Attorney, Agent, or Firm*—Antonelli, Terry & Wands

[57] ABSTRACT

The variable capacity swash plate compressor of the present invention includes a rotary swash plate having an eccentric mass located opposite to the driving point of the swash plate with respect to the axis of the same. The mass distribution in the rotary swash plate is established such that, within a range in which the piston stroke is less than a predetermined value, a moment about a pivot point produced by the rotation of the swash plate becomes larger than a moment produced by the reciprocating motion of pistons, piston rods and the like and acting upon the swash plate, while, within a range in which the stroke is larger than the predetermined value, the former moment becomes smaller than the latter moment. Accordingly, it is possible to provide a compressor of the type in which its capacity control characteristics are improved over a wide shaft speed range.

7 Claims, 7 Drawing Sheets

VARIABLE CAPACITY SWASH PLATE COMPRESSOR

BACKGROUND OF THE INVENTION

The present invention relates to a swash plate compressor of the variable stroke volume type which is adapted for use with an air conditioning system for vehicles.

Prior-art variable capacity compressors are set forth in U.S. Pat. Nos. 3,959,983, 3,861,829, Japanese Patent Examined Publication No. 4195/1983, U.S. Pat. No. 4,178,135 and Japanese Patent Examined Publication No. 2390/1986. In general, any of the compressors disclosed in these prior patents includes a rotary swash plate assembly having a rotary portion, the mass size and mass distribution of which are determined to balance the moment produced by the reciprocating motion of pistons, connecting rods and associated components over the whole ranges of inclinations or nutational angles and rotational speeds of the swash plate assembly. Also, in order to maintain the aforesaid balanced state, the rotary swash plate is provided with a ring-shaped balancing weight at one end of the hub of the swash plate or with a balancing weight at the periphery of the same.

In the aforementioned prior art, however, the compressor of the type in which the ring-shaped counterweight is attached to the hub of the rotary swash plate involves a problem in that the length of the compressor is increased in its axial direction. Also, the compressor of the type in which the counterweight is attached to the outer periphery of the hub involves a problem in that the compressor is increased in outer diameter. Accordingly, the prior art encounters various difficulties when the compressor is to be reduced in size and weight, and this may lead to a problem in that, when the compressor is to be incorporated in the engine compartment of a vehicle, the layout is limited.

If the aforesaid counterweight or balancing weight is omitted or reduced in weight in order to reduce the size and weight of the compressor, the moment produced by the reciprocating motion of the pistons or the like does not balance with the moment derived from the mass of a rotary member of the rotary swash plate assembly. This may cause an excessive level of vibration while the main shaft of the compressor is rotated at high speed. In addition, this may lead to an increase in the angular moment acting in the direction in which the length of piston stroke is increased, and hence, an increase in the level of force required for capacity control. This could result in a problem such as a lowering in control characteristics for capacity of the compressor.

Also, in accordance with the prior art, in order to restrict the maximum and minimum inclinations of the rotary swash plate, the length of travel of a pin serving as the nutational center of the rotary swash plate is limited in its axial direction. For this reason, the position of an inclination restricting portion serving to restrict the maximum and minimum inclinations of the swash plate is substantially coincident with or close to the nutational center of the swash plate. As a result, an excessive force acts on the aforesaid inclination restricting portion or pin and this may cause various problems; for example, the inclination restricting portion might undergo deformation or breakage.

SUMMARY OF THE INVENTION

It is therefore an object of the present invention to provide a rotary swash plate type of variable capacity compressor having capacity control characteristics which are improved over a wide speed range.

It is another object of the present invention to provide a rotary swash plate type of variable capacity compressor having a compact size and capacity control characteristics which are improved over a wide speed range.

It is another object of the present invention to provide a rotary swash plate type of variable capacity compressor which is improved so as to enable the limiting of the maximum and minimum capacities by using a simple structure.

The above-described objects are achieved by the present invention providing a mass distribution of the swash plate in which an eccentric mass portion is formed on a non-driven side of the swash plate at the portion opposite to an ear portion with respect to the axis of the swash plate. The mass distribution is established such that, within a range in which the piston stroke is less than a predetermined value, the moment about pivot point produced by the rotation of the swash plate becomes larger than the moment produced by the reciprocating motion of pistons, piston rods and the like and acting upon the same, while, within a range in which the stroke is larger than the predetermined value, the former moment becomes smaller than the latter moment. By these features of the present invention the capacity control characteristics are improved over a wide speed range.

As described above, the off-balanced distribution of the mass of the rotary swash plate eliminates the need of additional mass such as a balancing weight, counterweight or the like, and this enables a reduction in the size and weight of the compressor. In a highspeed range in which a small piston stroke is required, the moment produced by the rotation of the swash plate exceeds that produced by the reciprocating motion of the piston and the like, and thus the former moment acts in the direction in which the piston stroke is reduced. On the other hand, in a low-speed range in which a great piston stroke is required, the moment produced by the reciprocating motion of the pistons exceeds that produced by the rotation of the swash plate, and thus the former moment acts in the direction in which the piston stroke is increased. Accordingly, it is possible to improve the capacity control characteristics to a remarkable extent.

Further objects, features and advantages of the present invention will become apparent from the following description of a preferred embodiment of the invention, taken in conjunction with the accompanying drawings.

BRIEF DESCRIPTION OF THE DRAWINGS

FIG. 6A is side elevation while FIG. 6B is front elevation;

DESCRIPTION OF THE PREFERRED EMBODIMENT

FIGS. 1, 2, 3 and 4 respectively illustrate the overall construction of a variable capacity compressor in accordance with the present invention.

Figure 1:
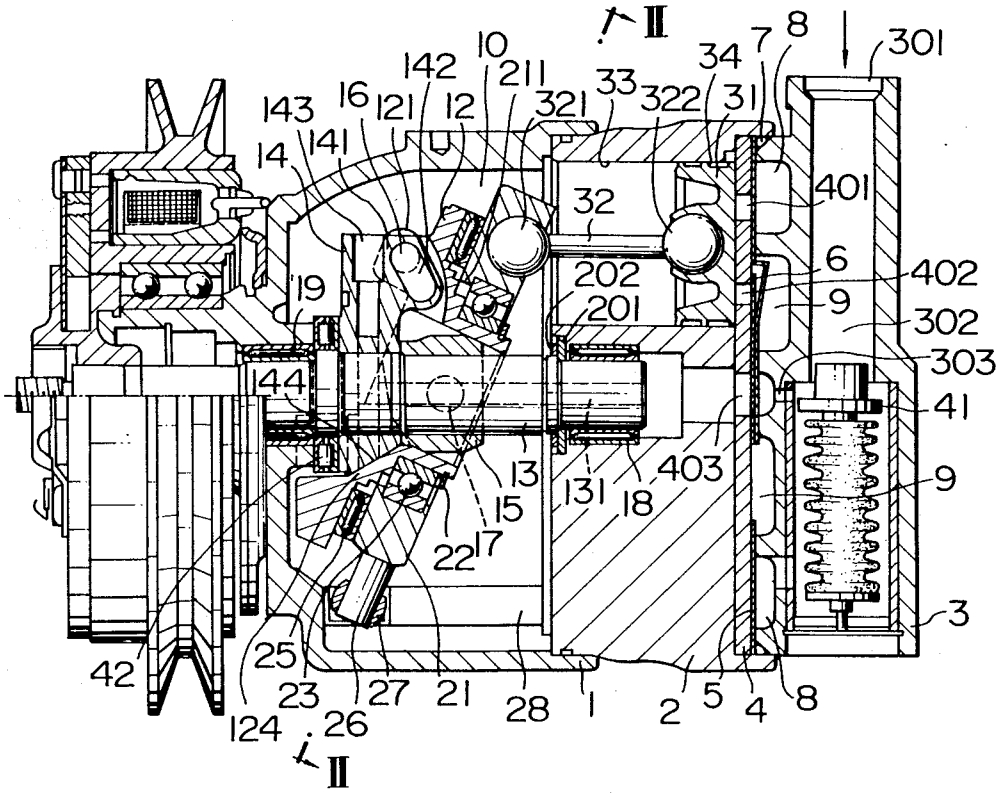
FIG. 1 is a vertical sectional view of a preferred embodiment of a variable capacity swash plate compressor in accordance with the present invention.
Figure 2:
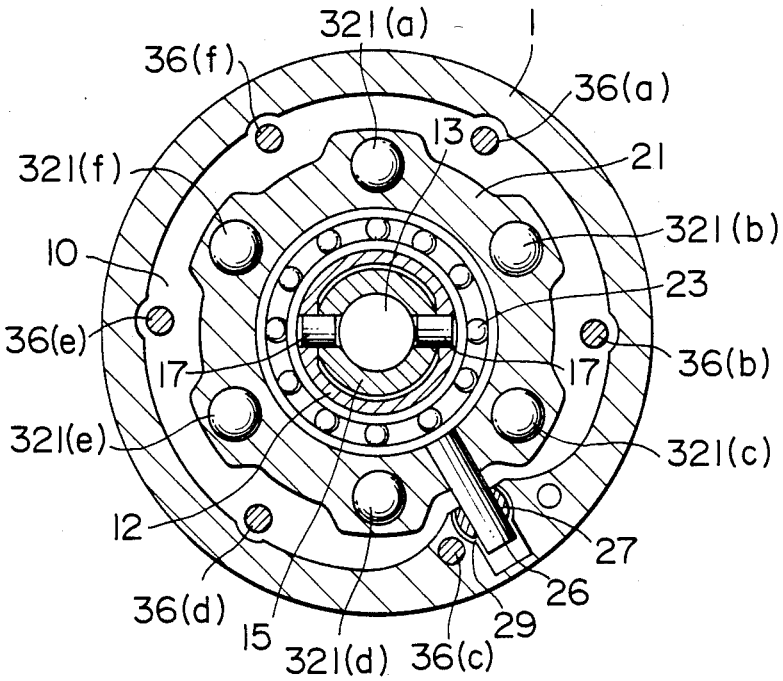
FIG. 2 is a sectional view taken along the line II—II of FIG. 1.
Figure 3:
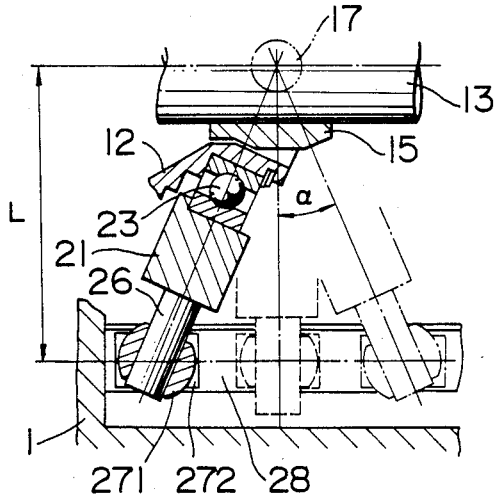
FIG. 3 is a detail view of a stopper portion for stopping the rotary motion of a piston support incorporated in the present invention.
Figure 4:
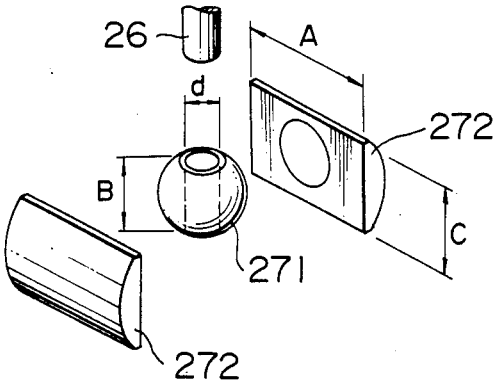
FIG. 4 is another detail view of the stopper portion shown in FIG. 3.

FIG. 1 illustrates a state wherein rotary swash plate 12 is located in a position corresponding to the maximum nutational angle, that is, the full-stroke position. Cylinder block 2 of cylindrical form has at its one end a central radial roller bearing 18 which supports main shaft 13 for rotation about its axis, and mains shaft 13 is likewise journalled in front housing 1 which is secured to cylinder block 2 to form a swash plate compartment 10. The cylinder block 2 includes a plurality of cylinders 33 which extend parallel to the axis of the main shaft 13 and are disposed along the circumference of the cylinder block 2. The main shaft 13 is located substantially on the center line of the cylinder block 2 and is rotatably supported by a radial roller bearing 18 disposed in the center of cylinder block 2 as well as by a central roller bearing 19 disposed in the center of front housing 1. The main shaft 13 has a drive plate 14 fixed thereto by means of press fitting or pin-fixing. The drive plate 14 has a cam groove 142 which receives a pivot pin 16 for movement therealong, the pivot pin 16 is fitted into swash plate ears 121 with tolerance provided therebetween. The ear 141 of the drive plate 14, where the cam grooves 142 are formed, and the swash plate ears 121 are adapted to come into contact with each other at their respective adjoining surfaces. In this arrangement, when rotation of the main shaft 13 causes rotation of the drive plate 14, rotational drive is imparted from the ears 141 of the drive plate 14 to the swash plate ears 121, and the swash plate 12 is thereby rotated. A sleeve 15 is fitted onto the main shaft 13 for sliding movement. The sleeve 15 and the swash plate 12 are rotatably coupled with each other through a pivot pin 17, making the swash plate capable of being inclined with respect to the main shaft 13. Accordingly, rotation of the main shaft 13 causes simultaneous rotation of the drive plate 14, the swash plate 12 and the sleeve 15. The swash plate 12 is engaged with a piston support 21 via a bearing 23 which is secured to a hub 124 of the swash plate 12 via a stopper ring or snap ring 22, thereby preventing the bearing 23 from being moved along the axis of rotation of the swash plate 12. A thrust bearing 25 is disposed in a gap formed between the swash plate 12 and the piston support 21 so as to restrict the radial movement of the piston support 21 as viewed in FIG. 1. A radially extending support pin 26 is secured to the piston support 21 by means of press-fitting or plastic bonding. As shown in FIGS. 3 and 4, a stopper member 27 is attached to the support pin 26, an the stopper member 27 is composed of a slide ball 271 fitted onto the pin 26 for sliding and rotating movement and of a pair of semi-columnar slide shoes 272 each having an inner surface provided with a ball receiving hemispherical recess. The slide shoes 272 are reciprocally movable in an axially extending guide groove 28 which is formed in the inner periphery of the front housing 1, thereby preventing the aforesaid piston support 21 from rotating about the axis of the main shaft 13. A plurality of (in this embodiment, six) connecting rods 32 respectively have spherical portions or balls 321 and 322 at their opposite ends. Each of the connecting rods 32 is rotatably captured by a corresponding recess formed in the piston support 21 at one end thereof, and is rotatably connected with pistons 31 at the other end. The aforesaid plurality of (six) pistons 31 are received in the corresponding number of (six) cylinders 33 formed in the cylinder block 2. A piston ring 34 is attached to each of the pistons 31. The cylinder block 2 is provided with a suction valve plate 5, a cylinder head 4, a discharge valve plate 6, a packing 7 and a rear cover 3. The cylinder block 2 is rigidly connected by means of bolts or the like to the front housing 1 enclosing the drive plate 14, the swash plate 12 and the piston support 21. The cylinder head 4 has pairs of a suction port 401 and a discharge port 402 in correspondence with each of the cylinders 33, and the suction ports 401 and the discharge ports 402 respectively communicate with a suction plenum 8 and a discharge gas plenum 9 formed in the rear cover 3. The rear cover 3 is provided with a suction port 301 and a discharge port (not shown). A suction bore 302 includes a control valve 41 at an intermediate position between the suction port 301 and the suction plenum 8. The upstream side of the control valve 41 communicates with the swash plate compartment 10 in the front housing 1 through a passage formed by bores 303, 403, a central bore 131 extending through the main shaft 13 and a path 143 connected to the bore 131 and radially opened in the drive plate 14. The downstream side of the control valve 41 communicates with the suction plenum 8.

The following is a description with respect to a mechanism serving to restrict the nutational angle of the swash plate 12.

Referring back to FIG. 1, in a process during which the nutational angle of the swash plate 12 increases, the sleeve 15 slides along the main shaft 13 from right to left as viewed in FIG. 1 while the swash plate 12 is nutated about the pivot pin 17 clockwise in the same Figure. When the swash plate 12 reaches a position of the maximum nutational angle (the full stroke), a conical surface 144 (nutational-angle restricting portion) formed on the drive plate 14 on the opposite side to the position of the cam groove 142 with respect to the axis of the main shaft 13 is brought into contact with a conical surface 126 (nutational-angle restricting portion) formed on the swash plate 12. In this state, a suitable clearance is provided between the sleeve 15 and the drive plate 14 as well as between the pivot pin 16 and the cam groove 142, thereby preventing these members from colliding with each other.

On the other hand, when the swash plate 12 reaches a position of the minimum nutational angle (zero piston stroke), one end of the sleeve 15 (the right-hand end as viewed in FIG. 1) comes into contact with a thrust washer 202 facing a thrust washer 201 secured to a bearing housing 21 in the cylinder block 2 whereby the minimum inclination of the swash plate 12 is restricted.

Thrust forces acting on the main shaft 13 in gas compressing process are born by a thrust bearing 42 disposed between the drive plate 14 and the front housing 1, while transverse forces are born by the two radial roller bearings 19 and 18 which are respectively provided in the front housing 1 and in the bearing housing of the cylinder block 2.

In the aforesaid arrangement, when the main shaft 13 of the compressor is driven by an engine (not shown), the drive plate 14 and the swash plate 12 are rotated, and thus the piston support 21 is wobbled with respect to the axis of the main shaft 13. In consequence, the respective pistons 31 are reciprocally moved in the cylinders 33 to perform the suction and compression of the gas.

The balance of moments about the pivot pin 17 is described below with reference to FIGS. 5, 6A and 6B.

Figure 5:
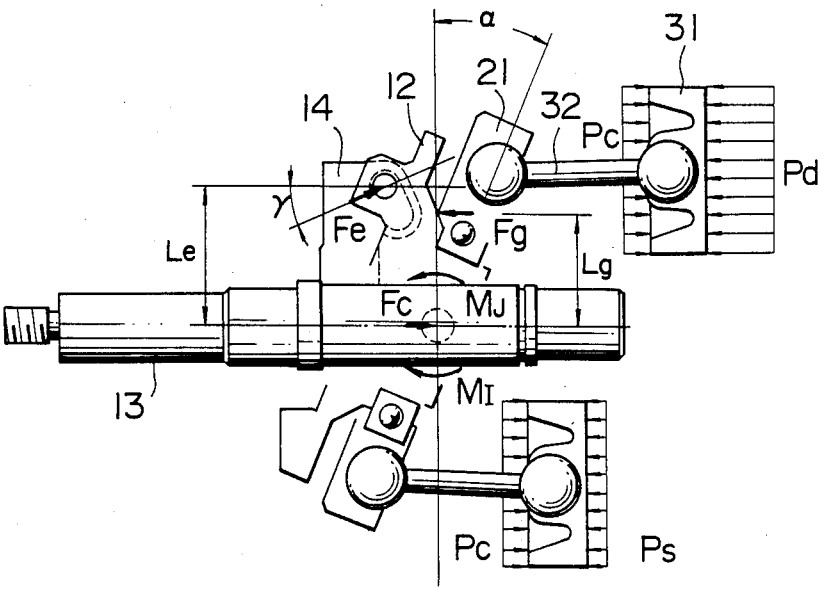
FIG. 5 is a schematic view used for explaining the principles of the capacity control.

Referring to FIG. 5, if FG represents the resultant of the gas compressing forces acting on the plurality of pistons 31 and LG represents the distance between the axis of the pivot pin to the point of application of FG, a moment MG acting on the swash plate 12 counterclockwise as viewed in FIG. 5, that is, in the direction in which the piston stroke is decreased, is represented by the following equation (1):

$$MG=FG\times LG \quad (1)$$

In the meantime, a force Fe acts from the pin 16 on the ears 121 of the swash plate 12. If Le represents the distance between the axis of the main shaft 13 and that of the pivot pin 16 fitted between the ears 121, and $\gamma$ represents the angle between the direction of the force Fe and the straight line parallel to the main shaft 13, a moment Me acting on the swash plate 12 clockwise as viewed in FIG. 5, that is, in the direction in which the piston stroke is increased, is represented by the following equation (2):

$$Me=-Fe\cos\gamma-Le \quad (2)$$

The inertial forces of the reciprocating pistons 31, the reciprocating connecting rods 32 and the wobbling piston support 21 act on the swash 12 as a clockwise moment MI. On the other hand, a counterclockwise inertia moment MJ is born in the rotating swash plate 12 according to the mass distribution, such as mass eccentricity, inherent in the swash plate 12 per se. Accordingly, where a balance is maintained among the respective moments about the axis of the pivot pin 17, the following relationship is established:

$$Me+MI+MG+MJ=0 \quad (3)$$

On the other hand, if Fc represents the resultant of the pressures of the swash plate compartment 10 acting on the underside of the pistons 31, the following relationship is established from the balance among the forces axially of the main shaft 13:

$$FG=FE\cos\gamma+Fc \quad (4)$$

In the aforesaid arrangement, when the level of pressure upstream of the control valve 41 becomes lower than a predetermined value because of a reduction in a heat load or of an increase in the shaft speed of the compressor, the opening of the control valve 41 is reduced, and thus the pressure level upstream of the control valve 41 is maintained at a fixed value. In the meantime, since a refrigerant channel is throttled by the control valve 41, the pressure level downstream of the control valve 41 is lowered. Because the pressure inside the swash plate compartment is maintained at a fixed level, while the gas compressing force FG acting on each of the pistons 31 is reduced, the value of MG decreases in the equation (1), and the swash plate 12 nutates counterclockwise to a balanced position, thus the piston stroke being reduced. In this way, the pressure downstream of the control valve 41, that is, the suction pressure of each of the cylinders 33 is varied so as to constantly maintain the pressure upstream of the control valve 41 at a level greater than a predetermined level, thereby controlling the stroke of each of the pistons 31. The difference between the pressure upstream of the control valve 41, i.e., a pressure Pc inside the swash plate compartment 10 and a pressure Ps developed at the inlet of each of the cylinders 33, is hereinafter referred to as a control differential pressure $\Delta$Pc.

It is to be noted that, the following relation is obtained from the equations (1), (2), (3) and (4):

$$MI+MJ+FcLe=FG(Le-LG)=F(\Delta Pc)(Le-LG) \quad (5)$$

If discharge pressure is fixed, the resultant FG of the compressive forces acting on the pistons is a function of the difference $\Delta$Pc between the pressure upstream of the control valve 41, i.e., the pressure Pc inside the swash plate compartment 10 and the pressure Ps developed at the inlet of each of the cylinders 33. The difference $\Delta$Pc is represented by the following equation:

$$\Delta Pc=Pc-Ps \quad (6)$$

Specifically, the piston stroke is controlled by varying the aforesaid differential pressure (control pressure).

Figure 6A:
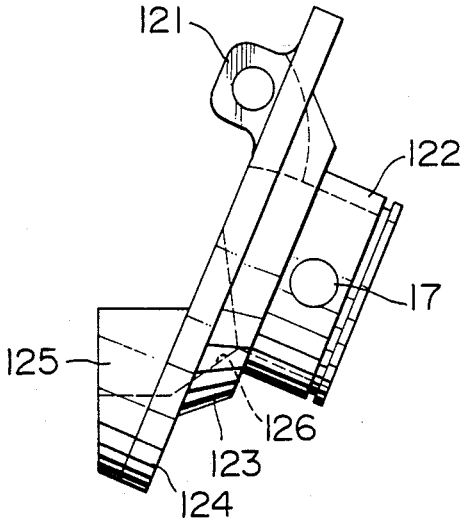
FIGS. 6A and 6B respectively show the structure of a swash plate incorporated in a preferred embodiment of the present invention.
Figure 6B:
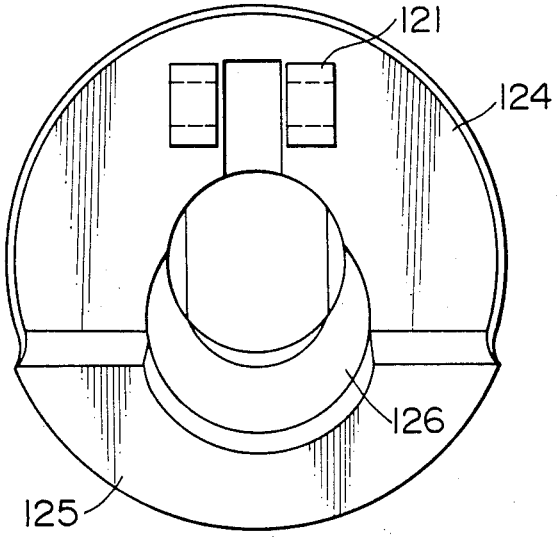

Referring to FIGS. 6A and 6B, there is shown a configuration of the swash plate 12. The swash plate 12 includes hub 122 rotatably receiving the pivot pin 17, disc portions 123, 124 and an eccentric mass portion 125. As shown in FIG. 6B, the eccentric mass portion 125 is located at a position corresponding to the lower dead point, and is constituted by a semi-ring shaped portion formed along the outer periphery of the disc portion 124.

As shown in FIG. 1, the eccentric mass portion 125 is formed such as to be accommodated in the space surrounded by the outer periphery of the thrust bearing 42 and the front housing 1.

Figure 7A:
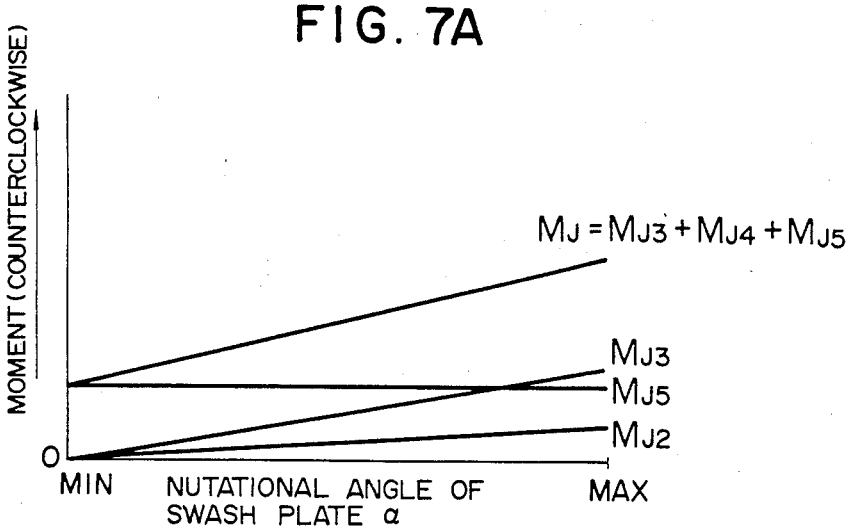
FIGS. 7A and 7B are graphs respectively used for explaining the magnitude and direction of nutational moments acting on the swash plate.

When the aforesaid respective components of swash plate are rotated together with the main shaft 13, various moments are produced about the pivot pins 17, and vary as shown in FIG. 7A, in accordance with variations in the nutational angle of the swash plate 12. Moments MJ2 and MJ3, which are derived from inertia forces of the masses of the hub 122 and the disc portion 123, 124, increase in substantial proportion to an increase in the nutational angle of the swash plate 12. In contrast, a moment MJ5, which is derived from inertia force of the mass of the eccentric mass portion 125, exhibits a substantially constant value irrespective of variations in the nutational angle. Also, since the distance between the eccentric mass portion 125 and the axis of the main shaft 13 is large and the length between the eccentric mass portion 125 and the pin 17 is long, a great moment is obtained by means of relatively small mass.

Figure 7B:
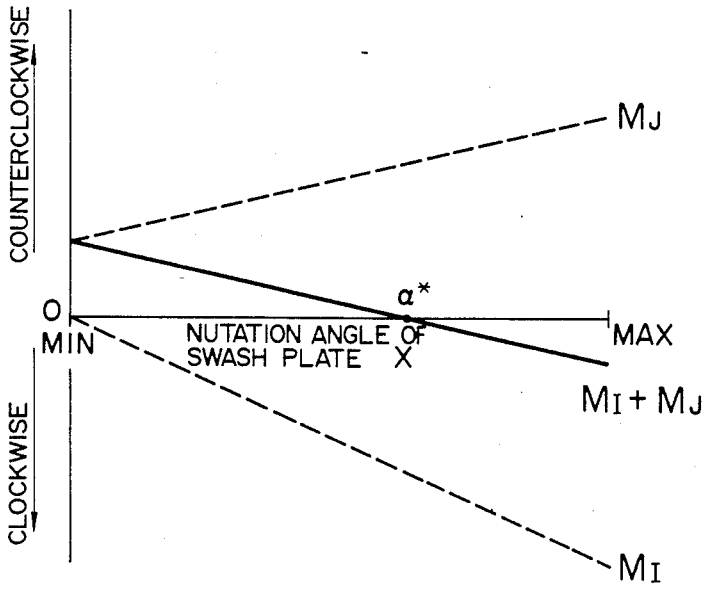

FIG. 7B shows the sum of the moment MI and the moment MJ among the moments produced about the axis of the pin 17 of the swash plate 12, the moment MI being derived from the reciprocating movements of the pistons 31 and the connecting rods 32 while the moment MJ is derived the rotating movements of the swash plate 12 having an unbalanced mass distribution. The moment MI is zero, when the swash plate 12 assumes the upright position (the nutational angle $\alpha=0$), and increases in substantial proportion to the nutational angle $\alpha$ of the swash plate 12 (refer to FIG. 5). In contrast, the moment MJ derived from the mass distribution inherent in the swash plate 12 varies as shown in FIGS. 7A and 7B. Thus, if both moments MI and MJ are combined, at a certain nutational angle $\alpha^*$, resultant moment MI+MJ becomes zero. In a range in which the nutational angle $\alpha$ is greater than $\alpha^*$, a clockwise moment is produced, while a counterclockwise moment is produced in a range in which the nutational angle $\alpha$ is smaller than $\alpha^*$. In other words, in a range in which the piston stroke is small, the moment acts so that the piston stroke is further reduced, while, in a range in which the piston stroke is great, the moment acts so that the piston stroke is further increased. In consequence, when the engine rotates at high speed with the piston stroke not more than a certain value ($\alpha<\alpha^*$), the moment derived from the rotation of the swash plate acts so as to reduce the piston stroke, and thus the level of control pressure required in nutating the swash plate is reduced. This is effective in improving the capacity control characteristics. Also, since the mass is eccentrically distributed on the part of the swash plate corresponding to the lower dead point, it is unnecessary to use such a ring-shaped balance mass as attached to the swash plate in the prior art. This produces a effect of greatly reducing the size and weight of the compressor. As shown in FIGS. 7A and 7B, it is preferred that the distribution of the eccentric mass is established such that the sum of moment MI and moment MJ becomes zero at a point which is somewhat shifted to the point of the maximum swash plate nutating angle from the middle point between the maximum and minimum angles. Also, at a point corresponding to the maximum nutational angle of the swash plate, it is preferred that the mass distribution is established such that the sum of the moments MI and MJ becomes not more than half of the moment MI at the same point. More specifically, the mass of the swash plate is preferably distributed in an eccentric manner such that, even if the compressor is driven at the maximum speed, the sum of the moments MI and MJ may not exceed the moment obtained from the control differential pressure as shown on the right side of the equation (5) (in this case, the maximum control differential pressure may be assumed as about 1.5 kg/cm$^2$G).

Figure 8A:
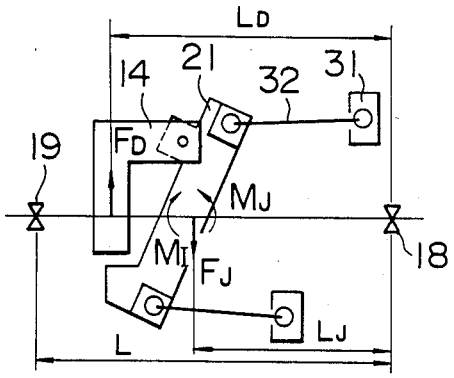
FIGS. 8A and 8B are views respectively used for explaining static and dynamic unbalancing forces and moments acting on the main shaft.
Figure 8B:
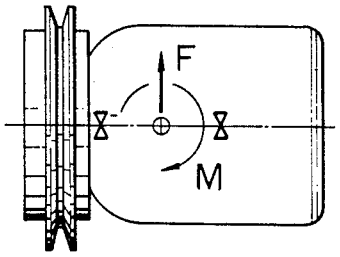

Static and dynamic balances of the main shaft 13 will be described below with reference to FIGS. 8A, 8B and 9. As described previously, various inertial forces are generated by the reciprocating motion of the pistons 31 and the piston rods 32 and the wobbling motion of the piston support 21. When the cylinders 33 are equally spaced around the periphery of the main shaft 13, the total sum of components of these inertial forces acting along the main shaft axis may become zero. However, since these inertial forces differ from one another in phase, the moment MI remains about the pivot pin 17 as described previously.

Since the swash plate 12 has the eccentric mass portion 125 as shown in FIGS. 6A and 6B, the gravity center of the swash plate 12 is not coincident with the center of the pivot pin 17. Accordingly, the moment MJ is produced about the pivot pin 17 by the centrifugal force as described previously, and a radial force FJ is produced with a direction toward the lower dead point.

Figure 9:
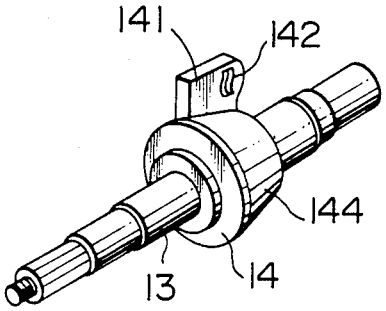
FIG. 9 is a perspective view of the main shaft mounted with a drive plate.

In order to reduce the unbalance among the radial forces and among the moments both acting on the main shaft 13, the drive plate 14 is formed with a shape as shown in FIG. 9, in which the mass distribution is increased at the portion adjacent to the ear 121 in symmetry with a plane passing through the ear 121, thereby generating a radial centrifugal force FD having a direction toward the upper dead point. In consequence, a resultant radial inertial force F and a resultant moment M about a midpoint between journal points of the main shaft, both acting on the main shaft, are respectively represented by the following equations:

$$F=FJ+FD \tag{7}$$

$$M = MI + MJ - \left(\frac{L}{2} - LJ\right)FJ - \left(\frac{L}{2} - LD\right)FD \tag{8}$$

Figure 10:
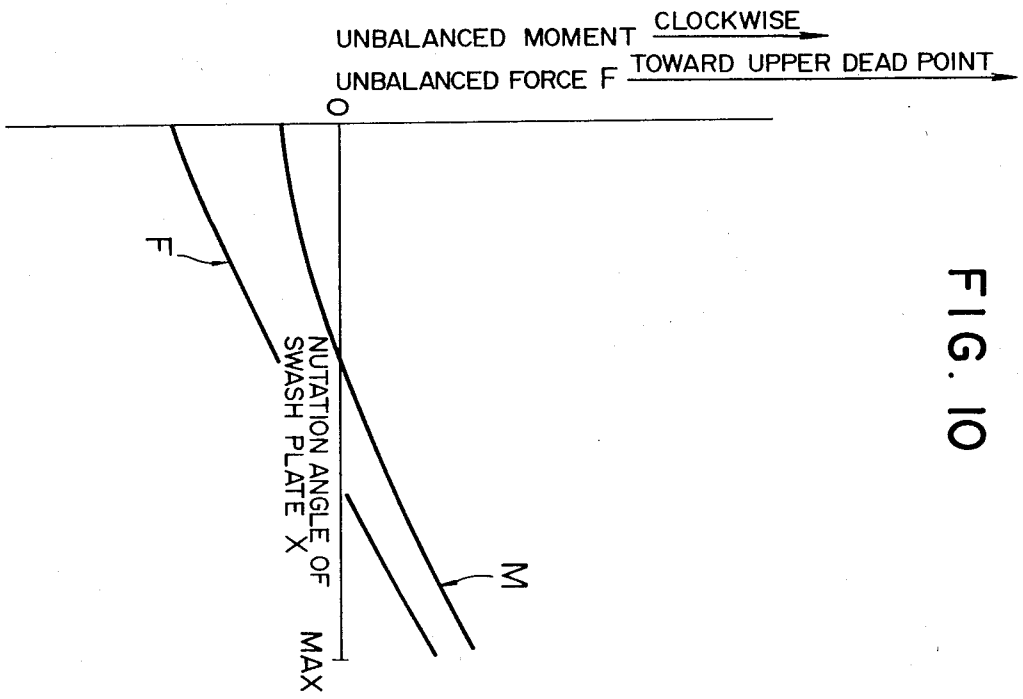
FIG. 10 is a graph showing the magnitudes and directions of unbalanced force and moment acting on the main shaft, respectively.

Although the unbalances vary in accordance with variations in the nutational angle of the swash plate as shown in FIG. 10, if size of the balance mass and positions of supporting points for main shaft are suitably selected, the static and dynamic unbalances are considerably reduced and thus the level of vibration and noise can be suppressed to a level which can be ignored in practical use. The balance mass distribution in the swash plate 12 and the balance mass distribution in the drive plate 14 are preferably determined so that the aforesaid unbalanced inertial force F and moment M respectively may reach their points of equilibrium at the middle point between the points of maximum and minimum nutational angles of the swash plate 12 as shown in FIG. 7. This arrangement is effective in obtaining a compressor of the type in which the level of vibration is decreased over the entire capacity control range of the compressor. As described above, in accordance with the present invention, the respective amounts of static and dynamic unbalances of the radial force F and of the moment M are reduced not only by the action of the mass distribution in the swash plate, but also by providing a mass balance on the drive plate, resulting in a compressor which has reduced size and weight, and decreased level of vibration.

The above descriptions have referred to a variable capacity swash plate compressor of the type in which the pressure inside the swash plate compartment is maintained at a constant level, and the nutational angle of the swash plate is controlled by making the pressure at the suction portion of cylinders lower than the pressure in the swash plate compartment via a control valve. However, as will be readily understood by those skilled in the art, the present invention achieves similar effects with respect to a variable capacity swash plate compressor of the type which is disclosed in U.S. Pat. Nos. 3,959,983 and 3,861,829 as well as Japanese Patent Examined Publication No. 4195/1983 and in which the pressure at each cylinder inlet is maintained at a constant level, and the nutational angle of the swash plate is controlled by increasing the pressure inside the swash plate compartment by using a blow-by gas or the like.

What is claimed is:

1. A variable capacity swash plate compressor, including:

a housing having therein a crank room, a suction plenum communicating with a suction bore of the compressor, and a discharge gas plenum, a drive shaft rotatably supported in said housing, a plurality of cylinders disposed in parallel with the axis of said drive shaft and spaced apart along the circumference of said drive shaft, a plurality of pistons respectively received in said plurality of cylinders for reciprocating movement therein, a plurality of rows connected to said plurality of pistons, respectively;

a piston support for supporting said plurality of rods;

a control valve disposed in said suction bore with the upstream side thereof communicating with said crank room and with the downstream side thereof communicating with said suction plenum, a swash plate attached to said drive shaft for rotation about the axis normal to the axis of said drive shaft, the nutational angle of said swash plate being controlled by a pressure difference upstream and downstream of said control valve, and the nutational motion of said swash plate causing reciprocating motions of said pistons with strokes corresponding to said nutational angle of said swash plate, and a pivot pin for rotatably supporting said swash plate on said drive shaft, said swash plate comprising a mass distribution so determined that, when said pistons and said rods are reciprocatingly moved and said piston support is wobbly moved, the sum of a first nutational moment and a second nutational moment is varied in magnitude and/or direction in accordance with variations in the nutational angle of said swash plate, said first nutational moment being a moment acting upon said swash plate about the axis of said pivot pin produced by the inertial forces of said pistons, rods and piston support along the axis of said drive shaft and said second nutuational moment being a moment about the axis of said pivot pin produced by the rotation of said swash plate per se having said mass distribution.

2. A variable capacity swash plate compressor according to claim 1, wherein said sum of said first and second nutational moments acts in the direction in which the piston stroke is reduced when said nutuational angle of said swash plate is smaller, while in the direction in which said piston stroke is increased when said nutational angle of said swash plate is larger.

3. A variable capacity swash plate compressor according to claim 1, wherein the sum of said first and second nutational moments reaches zero in the vicinity of a nutational angle corresponding to half of the full piston stroke.

4. A variable capacity swash plate compressor according to claim 1, wherein said second nutational moment acts in the direction in which said piston stroke is reduced over the entire nutational angle range of the swash plate, while said first nutational moment acts in the direction in which the piston stroke is increased, and wherein in a range in which said piston stroke is small, said second nutational moment becomes greater than said first nutuational moment, while in a range in which said piston stroke is larger, said second nutational moment is smaller than said first nutational moment.

5. A variable capacity swash plate compressor according to claim 4, wherein said swash plate includes:

a hub portion for supporting said pivot pin;

a disc portion; and an eccentric mass portion formed in the shape of a semi-ring and located along a part of the outer periphery of said disc portion adjacent to the lower dead portion of the swash plate and at the side opposite to said pistons.

6. A variable capacity swash plate compressor according to claim 1, further including stopper means for preventing the rotation of said piston support about the axis of the drive shaft, said stopper means including:

a support pin connected to said piston support; and an intermediate slidable and rotatable member interposed between said support pin and said housing.

7. A variable capacity swash plate compressor according to claim 6, wherein said intermediate slidable and rotatable member includes: a rolling member slidably and rotatably fitted on said support pin and having a spherical portion on its outer periphery; and slide shoe members each having on one side a hemispherical recess for receiving said spherical portion of said rolling member and an outer periphery engageable with a guide groove formed in the wall of said housing.

* * * * *